US006473929B1

(12) United States Patent
Learned, III

(10) Patent No.: US 6,473,929 B1
(45) Date of Patent: Nov. 5, 2002

(54) ISOKINETIC PAINT BRUSH HANDLES

(76) Inventor: Addison Woodbury Learned, III, P.O. Box 164, N. Abington, MA (US) 02351

( * ) Notice: Subject to any disclaimer, the term of this patent is extended or adjusted under 35 U.S.C. 154(b) by 0 days.

(21) Appl. No.: 09/233,805

(22) Filed: Mar. 10, 1998

Related U.S. Application Data

(63) Continuation-in-part of application No. 08/778,087, filed on Jan. 2, 1997, now abandoned.

(51) Int. Cl.[7] ..... B25G 1/00; A46B 5/00

(52) U.S. Cl. ..... 15/146; 15/143.1; 15/145; 16/427; 294/19.1; D4/135; D4/138

(58) Field of Search ..... 15/143.1, 144.1, 15/144.2, 144.3, 144.4, 145, 146; 16/427; 294/19.1; D4/130, 132, 135, 138

(56) References Cited

U.S. PATENT DOCUMENTS

D85,251 S * 9/1931 Lynde ..... 15/143.1 X
2,346,570 A * 4/1944 Francis ..... 15/146
2,443,233 A * 6/1948 Filardo ..... 15/144.1
3,319,280 A * 5/1967 Trachsler ..... 15/146
3,336,617 A * 8/1967 Bosko et al. ..... 15/146
3,357,035 A * 12/1967 Ficke ..... 15/144.1
3,413,043 A * 11/1968 Bertolina ..... 15/144.1 X
3,668,731 A * 6/1972 McBride ..... 15/146
3,737,187 A * 6/1973 Pryor ..... 15/144.1 X
3,984,892 A * 10/1976 Kyriakou ..... 15/144.1 X
3,994,037 A * 11/1976 Sims ..... 15/146
4,127,296 A * 11/1978 Thomson ..... 15/144.1 X
4,157,598 A * 6/1979 Talent et al. ..... 15/145
4,715,080 A * 12/1987 Rydzicki ..... 15/146
5,329,663 A * 7/1994 Council ..... 15/146 X
5,606,772 A * 3/1997 Ilic ..... 15/145 X

* cited by examiner

*Primary Examiner*—Mark Spisich

(57) ABSTRACT

An extension handle for use with a paint brush. The extension handle being removably secured to the handle of the paint brush to either retain the brush aligned with the extension handle in one embodiment or at a fixed acute angle relative thereto in another embodiment. The length of the extension handle being selected to enable both hands of the user to be used.

2 Claims, 3 Drawing Sheets

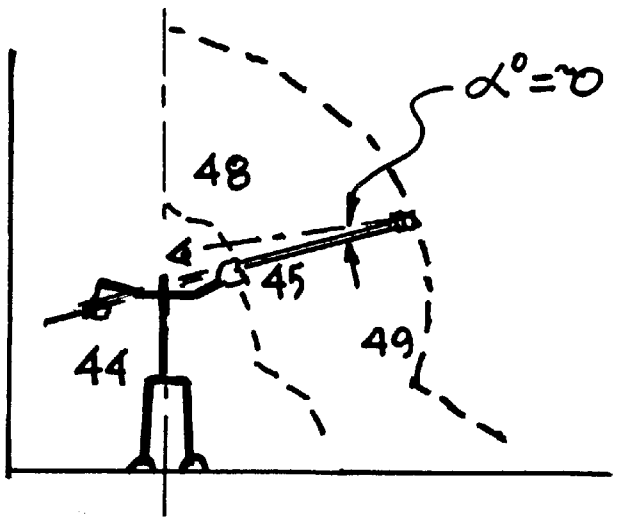
FIG. 1B
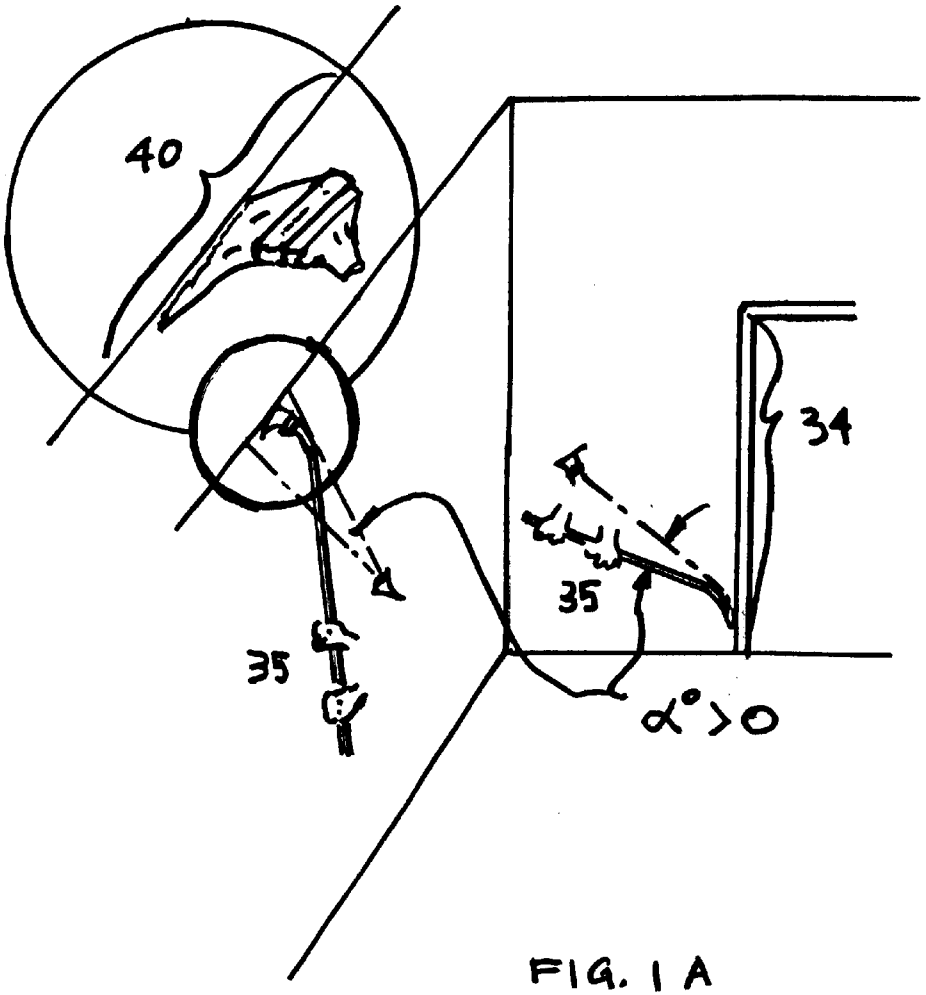
FIG. 1A
FIG. 1

ISOKINETIC PAINT BRUSH HANDLES

CROSS REFERENCE TO RELATED APPLICATION

This application is a continuation-in-part of application Ser. No. 08/778,087, filed Jan. 2, 1997, now abandoned.

BACKGROUND OF THE INVENTION

Prior art paint brushes have handles which are long enough for being grasped by only one hand of the user. This requires that a clear line of sight may be achieved by the painter moving his/her body to expose to expose a visual sight line. The present invention pertains to the provision of a paint brush handle which is long enough to be grasped by both hands of the user. This increase in length allowing the user to present a brush with paint against the surface to be painted that exposes the cut line to a visual sight line without undue exertion on the part of the user.

SUMMARY AND OBJECTS OF THE INVENTION

The primary object of the present invention is to permit the user to use both hands to better expose the cut line to an eye visual sight line. An isokinetic analysis of the basic idea of the present invention as compared to the prior art is illustrated in FIGS. 1A and 1B. The movements of a painter require that their body be positioned to attitude (in FIG. 1B, the locus of points 44) that allows them to present a brush with paint against the surface to be painted, with one arm extended and the hand cocked to an attitude that exposes the cut line to an eye visual sight line. Because common brushes handle handles large enough for only one hand, the reaching must be accomplished by the painter's body movements (in FIG. 1B, the locus of points 45). It is an object of the present invention to provide a means for expanding the field of coverage (in FIG. 1B, areas 48 and 49 and in FIG. 1A, areas 34 and 40) at each location (in FIG. 1B, locus of points 45) with the addition control of two hands (in FIG. 1A, locus of points 35) coordinated with the sight line of cut, considerably reducing the painter's body movements.

A more specific object is to provide paint brush handles that affix to paint brushes at the specific angle with the line of sight without obstructing the painter's view of the cut line, whereby the angle is not alterable (i.e. it is fixed) determined by the length of the handle.

Yet another object of the invention is to provide such two hand spacing equivalent to average elbow spacing on handles made continuous with the bristles.

BRIEF DESCRIPTION OF THE DRAWINGS

FIGS. 1A and 1B pertain to the isokinetic analysis of the basic concept of the present invention as they pertain to prior art single-hand paint brushes;

DESCRIPTION OF THE PREFERRED EMBODIMENTS

Figure 2:
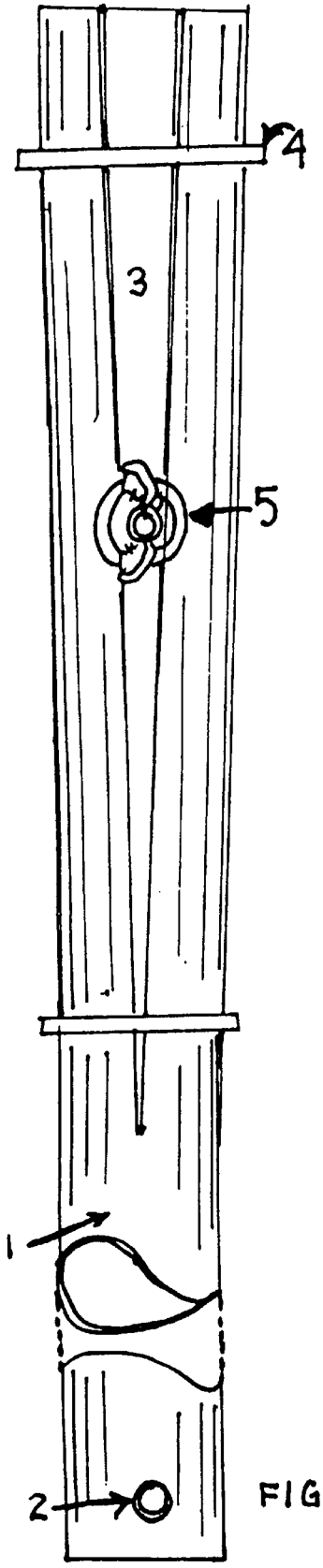
FIG. 2 is a side view of a first embodiment of the invention.

The first embodiment is illustrated in FIG. 2. It includes an elongated tubular extension handle (1) which includes an elongated slot (3) at a distal end thereof The distal end of the handle (1) adapted to receive the end of a paint brush handle including a hole in the end thereof The slot (3) enabling the distal end of the tubular extension handle to be compressed onto the paint brush handle. A nut/bolt/washer assembly (5) passes through the hole in the end of the paint brush handle to secure the paint brush within the tubular extension handle (1). A flexible band (4) is also provided to compress the tubular handle (1) against the handle of the paint brush. A hole (2) may be provided in the proximal end of the extension handle (1) to permit hanging thereof for storage and non-use. In this embodiment, the paint brush is maintained in a fixed position that is aligned with the length of the tubular extension handle (1).

Figure 2A:
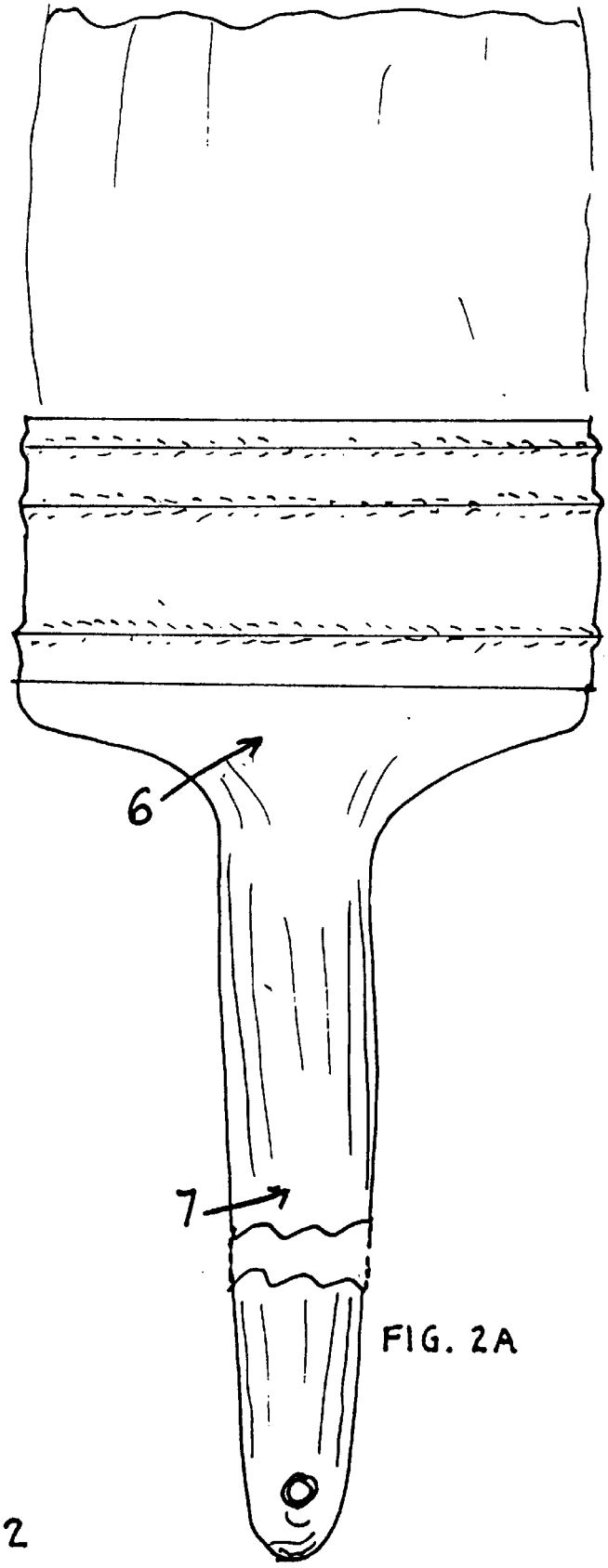
FIG. 2A is a view of a second embodiment of the invention.

The second embodiment is illustrated in FIG. 2A. This embodiment is a modification of a paint brush (6) which involves the provision of a lengthened handle portion (7) which is long enough for spaced two-hand manipulation thereof. This second integral embodiment may include either bristles in line with the gripping portion as well as bristles disposed at an acute angle with respect to the gripping portion.

Figure 3A:
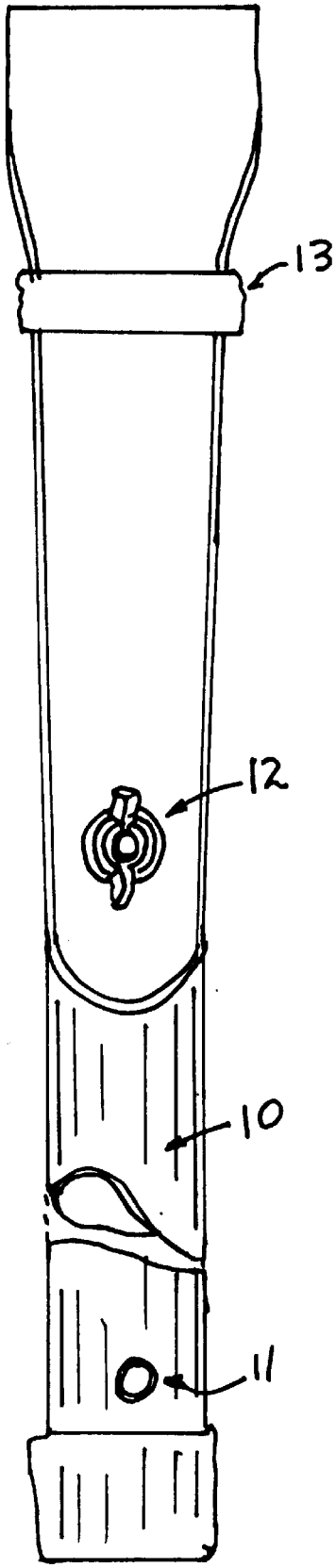
FIGS. 3 and 3A are side and top views, respectively, of a third embodiment of the invention.
Figure 3:
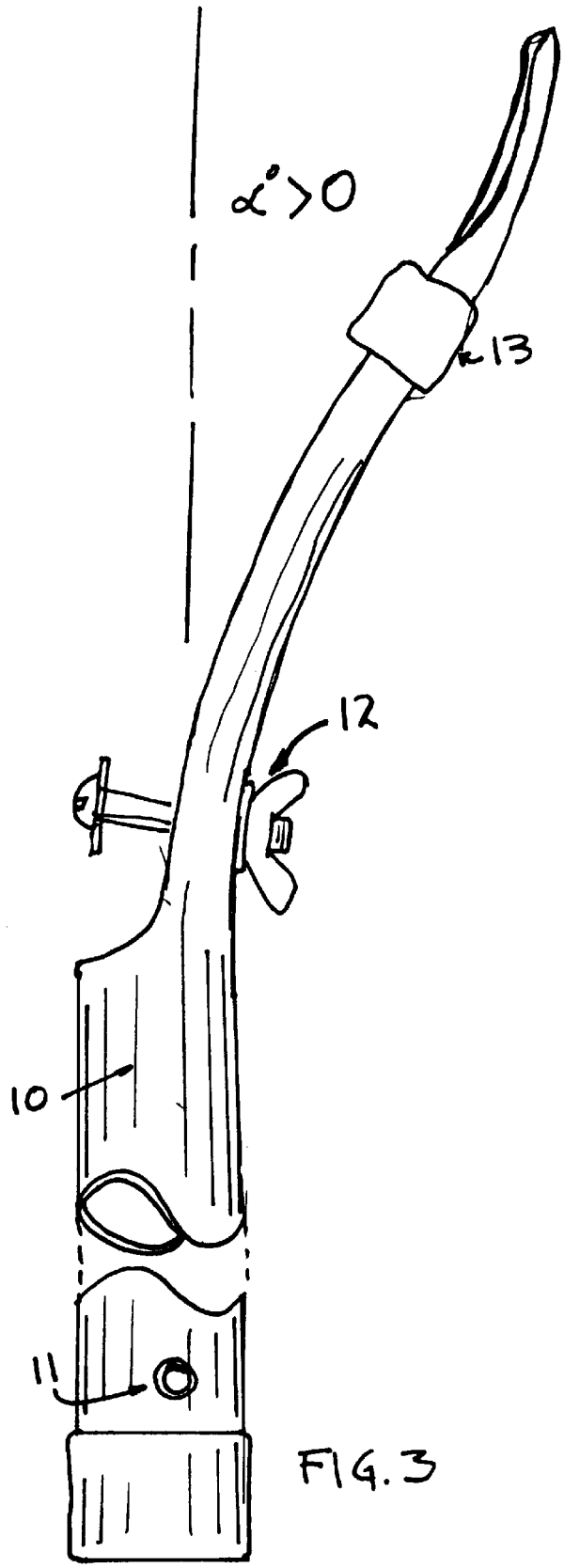

The third embodiment is illustrated in FIGS. 3 and 3A. It includes an elongated tubular extension handle (1O) which has an angled brush supporting portion extending from a distal end thereof This bush supporting portion being oriented at a fixed acute angle (alpha) with respect to the remainder of the extension handle (10). This embodiment also includes a nut/bolt/washer assembly (12) and flexible band (13) which have essentially the same purpose as in the first embodiment. The handle (10) of the third embodiment may also be provided with a hole (11) for hanging the handle (10) when not in use. In this embodiment, the paint brush is maintained in a fixed position that is at an acute angle with respect to the axis of the tubular extension handle (10).

What is claimed is:

1. An extension handle for use with a paint brush including a plurality of bristles extending from a distal end of an elongated brush handle with the brush handle including a hole in a proximal end thereof, the extension handle comprising:

an elongated tubular handle having a length sufficient for grasping by both hands of the user, said tubular handle including an elongated slot at a distal end thereof which defines an expandable hollow portion for receiving the brush handle of the paint brush, the expandable hollow portion being substantially aligned with the longitudinal axis of the tubular handle;

means, spaced from the distal end of the tubular handle adjacent an end of said elongated slot, for passing through the hole in the end of the paint brush handle and securing the paint brush handle with respect to the tubular handle;

a flexible band between the distal end of the tubular handle and the means for passing through the hole in the paint brush handle for compressing the walls of the expandable hollow portion of the tubular handle against the handle of the paint brush to further secure it to the tubular extension handle; and wherein the handle of the paint brush and the tubular extension handle are fixedly maintained in a substantially aligned orientation.

2. An extension handle for use with a paint brush including a plurality of bristles extending from a distal end of an elongated brush handle with the brush handle including a hole in a proximal end thereof, the extension handle comprising:

an elongated tubular handle having a length sufficient for grasping by both hands of the user, an elongated brush supporting portion extending from a distal end of the tubular handle which is oriented at a fixed acute angle with respect to the longitudinal axis of said tubular handle;

means, spaced from the distal end of the brush supporting portion, for passing through the hole in the end of the paint brush handle and securing the paint brush handle with respect to the tubular handle;

a flexible band between the distal end of the brush supporting portion and the means for passing through the hole in the paint brush handle for retaining the paint brush handle against the brush supporting portion to further secure it to the tubular extension handle; and wherein the paint brush handle and the tubular extension handle are maintained at a fixed acute angle with respect to each other.

* * * * *